United States Patent [19]

Sander et al.

[11] 4,119,350

[45] Oct. 10, 1978

[54] CUTTER DRUM

[75] Inventors: Rolf Sander, Essen; Klaus Oberste-Beulmann, Sprockhovel, both of Fed. Rep. of Germany

[73] Assignees: Gebr. Eickhoff, Maschinenfabrik und Eisengiesserei, m.b.H., Bochum; Bergwerksverband, G.m.b.H., Essen, both of Fed. Rep. of Germany

[21] Appl. No.: 796,344

[22] Filed: May 12, 1977

[30] Foreign Application Priority Data

May 13, 1976 [DE] Fed. Rep. of Germany ..... 2621261

[51] Int. Cl.[2] ..... E21C 25/10

[52] U.S. Cl. ..... 299/87; 175/394

[58] Field of Search ..... 299/87, 90; 175/376–378, 394

[56] References Cited

U.S. PATENT DOCUMENTS

| | | | |
|---|---|---|---|
| 2,967,701 | 1/1961 | Wilcox | 299/87 X |
| 2,967,701 | 1/1961 | Wilcox | 299/87 X |
| 2,979,319 | 4/1961 | Anderson | 299/87 X |
| 3,139,148 | 6/1964 | Robbins | 175/376 X |
| 3,158,403 | 11/1964 | Adams et al. | 299/90 |
| 3,174,801 | 3/1965 | Owen | 299/90 X |
| 4,046,207 | 9/1977 | Taylor | 175/394 X |

FOREIGN PATENT DOCUMENTS

| | | | |
|---|---|---|---|
| 1,130,147 | 10/1968 | United Kingdom | 299/87 |

*Primary Examiner*—Ernest R. Purser
*Assistant Examiner*—Nick A. Nichols, Jr.
*Attorney, Agent, or Firm*—Thomas H. Murray

[57] ABSTRACT

A screw-type cutter drum is provided having helical ribs on the drum body with cutter picks on the ribs and on the end of the drum. The cutter picks at the end of the drum are arranged in sets spaced apart to coincide with the ends of the ribs and the cutter picks of each set are equally spaced apart angularly and placed at different radial distances from the axis which decrease in the direction of rotation.

3 Claims, 4 Drawing Figures

CUTTER DRUM

BACKGROUND OF THE INVENTION

The present invention relates to screw-type cutter drums for mining machines, and more particularly to cutter drums of the type having cutter picks carried on helical ribs on the body of the drum and additional cutter picks on the end face of the drum adjacent the working face.

Drum cutters for mining coal, or other minerals, are known having helical ribs on the circumferential surface of the drum body which function to convey the coal away from the working face and which have cutter picks mounted on their outer surfaces. Cutter picks have also been mounted on the end of the cutter drum in a radial line and spaced at varying radial distances from the axis, as shown, for example, in German Pat. No. 1,216,821.

Cutter drums are also known as shown, for example, in German Gebrauchsmuster No. 1,993,515 in which cutter picks are mounted on the circumference and surface of a mounting disc attached to the working face end of the cutter drum. The circumference of such a mounting disc has interruptions or gaps corresponding in position to the channels between the helical ribs on the drum body and the radial projections between these gaps coincide in position with the end surfaces of the helical ribs. The cutter picks are mounted on the radial projections and the end surface of the mounting disc and are arranged in radial rows with non-uniform radial spacing between picks. Such an arrangement of cutter picks could, of course, also be attached directly to the end surface of the drum and the end surfaces of the helical ribs.

To improve pickup of the coal or other material being mined by the cutter drum, the channels between the helical ribs should terminate at the working face end in openings of the largest possible cross section in order to facilitate pickup of the mined material without further breakage and to minimize the formation of dust. This, however, results in a large space, or circumferential distance, between the cutter picks on opposite sides of each such opening. Since the cutter drum is continuously moved transversely of its axis by the mining machine, the cutter picks adjacent the openings are always required to make the deepest cuts, and smooth operation of the cutter drum is difficult to obtain.

SUMMARY OF THE INVENTION

In accordance with the present invention, a screw-type cutter drum is provided having cutter picks arranged on the working face end of the drum in such a manner that in spite of the different circumferential spacing between picks in different parts of the drum, due to the large required area of the conveyor channels, each cutter pick always operates at the same depth of cut.

This result is obtained in cutter drums of the general type described above by arranging the cutter picks on the end of the drum in sets spaced apart in correspondence with the ribs on the drum and with the picks of each set arranged so that successive cutter picks in the direction of rotation of the drum are angularly spaced apart at equal angles and their radial distances from the axis decrease by a constant amount $\Delta r'$ defined by the following relation:

$$\Delta r' = \frac{1}{z-1}\left[\frac{10\,V_M}{4n_W}\cdot\frac{\beta}{90^\circ} - a\right]$$

where:

$V_M$ = the rate of advance of the mining machine in meters per minute;

$n_W$ = the cutter drum speed in RPM;

$\beta$ = the angle between the first cutter pick of one set and the last cutter pick of the adjacent set;

$z$ = the number of cutter picks in each set; and $a$ = the depth of cut in millimeters.

The number $z$ of cutter picks in a set and the angle $\beta$ are determined in the design of the cutter drum and depend on the dimensions of the end face of the cutter drum, while the maximum depth of cut $a$ is determined by the type of cutter pick to be used. The dimension $\Delta r'$ can readily be calculated, therefore, from the rate of advance of the mining machine $V_M$ and the cutter speed $n_W$. If the cutter picks are arranged as described, the depth of cut for each cutter pick will not exceed the set dimension $a$, even at the maximum speed of advance of the mining machine and in spite of the large space between adjacent picks of different sets. This is because the first cutter pick of each set is at a substantially smaller radial distance from the axis than the last cutter pick of the preceding set, so that all cutter picks on the end of the drum are equally loaded, and the pick life and the smoothness of operation of the drum are greatly improved. The cutter picks may be mounted directly on the end areas of the helical ribs of the cutter drum, or they may be mounted on an end plate suitably shaped and attached to the end surface of the drum.

BRIEF DESCRIPTION OF THE DRAWINGS

The invention will be more fully understood from the following detailed description, taken in connection with the accompanying drawings, in which.

DESCRIPTION OF THE PREFERRED EMBODIMENT

Figure 1:
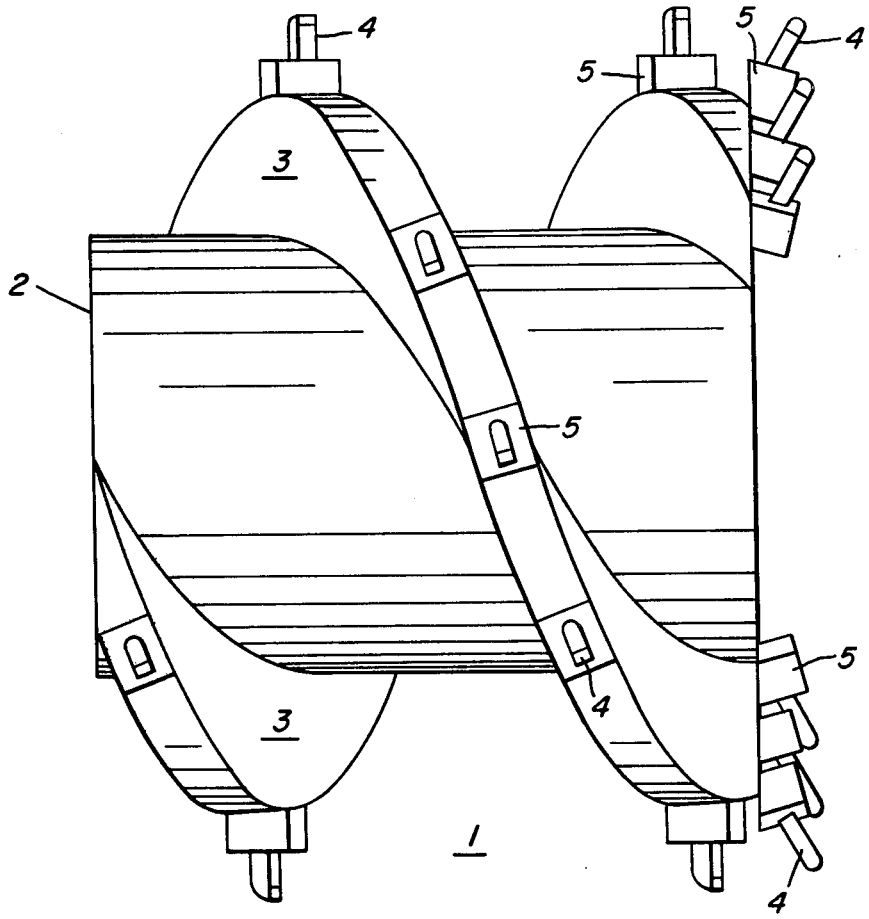
FIG. 1 is a somewhat diagrammatic side view of a cutter drum embodying the invention, with cutter picks mounted directly on the end areas of the helical ribs.
Figure 2:
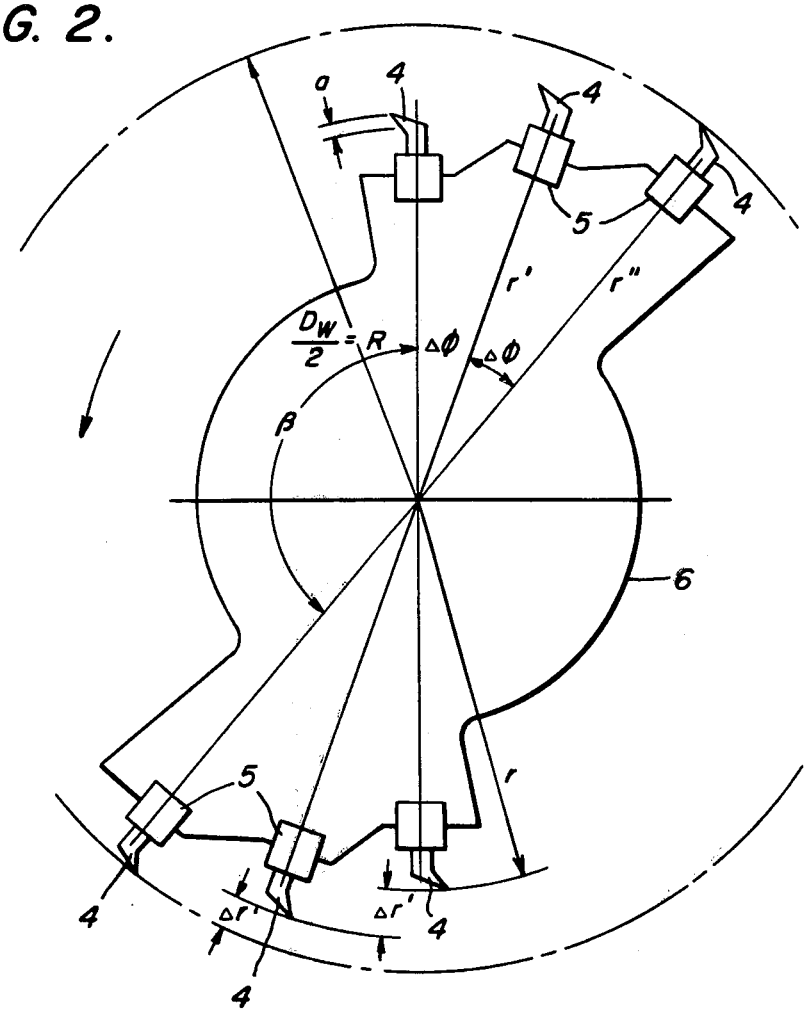
FIG. 2 is an end view showing the arrangement of the sets of cutter picks, and showing them mounted on a separate end plate.

FIG. 1 shows a screw-type cutter drum 1 of typical construction but with the cutter picks arranged in accordance with the present invention. The cutter drum 1 has a cylindrical body or drum member 2 with two helical ribs 3 extending around the body 2 and terminating at the right-hand end approximately 180° apart. The ribs 3, as can be seen in FIG. 1, have relatively wide channels between them which serve as conveyors for removing the coal, or other material, from the working face which would be at the right as seen in FIG. 1. The cutter drum is provided with cutter picks 4 mounted in pick holders 5 attached to the outer surfaces of the helical ribs 3. In addition, cutter picks 4 are mounted at the working face end of the cutter drum. The cutter picks 4 on the end surface are disposed in circumferentially-spaced sets corresponding in position to the ribs 3, and they may be mounted directly on the end areas of the ribs themselves, as shown in FIG. 1, or they may be mounted on a separate end plate 6, as shown in FIG. 2, which is mounted on the end of the drum 2. The cutter picks may be mounted on, or attached to, the cutter drum in any desired manner and the mounting means have not been shown in detail as they are not a part of the invention. In either case, the cutter picks 4 of each set are spaced circumferentially from each other with equal angular spacing and are arranged with their cutting edges at different radial distances from the axis of the drum in accordance with the relation mentioned above and which is more fully described below.

Figure 3:
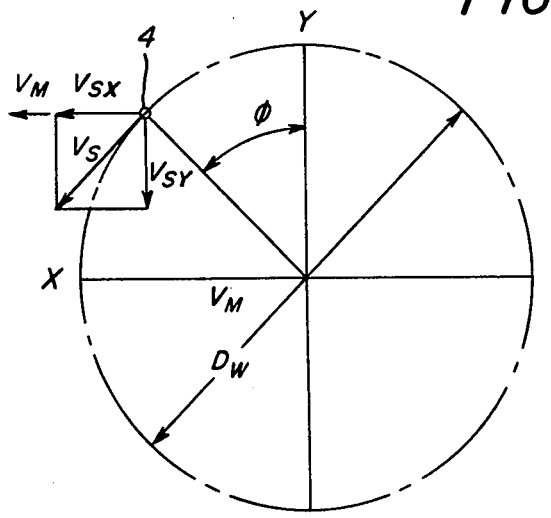
FIG. 3 is a diagram showing the components of motion of a cutter pick moving in its circular path.

FIG. 3 shows the path of travel of a cutter pick 4 about the axis of the cutter drum, the position of the pick at any time being defined by its angle $\theta$ with respect to the vertical or Y axis. The peripheral speed, or cutting speed, of the pick is represented at $V_S$ and the speed of advance of the mining machine which carries the cutter is represented at $V_M$ and is transverse to the axis of the cutter drum. The instantaneous components of motion of the picks 4 in the X and Y directions, for different positions of the pick, are seen to be as follows:

| | | |
|---|---|---|
| $\phi = 0°$ | $V_X = V_S + V_M$ | $V_Y = 0$ |
| $\phi = 90°$ | $V_X = V_M$ | $V_Y = V_S$ |
| $\phi = 180°$ | $V_X = -V_S + V_M$ | $V_Y = 0$ |
| $\phi = 270°$ | $V_X = V_M$ | $V_Y = -V_S$ |
| $\phi = 360°$ | $V_X = V_S + V_M$ | $V_Y = 0$ |

These limiting conditions are satisfied by the following relations for the instantaneous components of motion:

$$V_X = V_S \cos\theta + V_M \quad (1)$$

$$V_Y = V_S \sin\theta \quad (2)$$

If $S_X$ represents the travel of the pick 4 in the X direction, $$dS_X/dt = V_X$$

and from Equation (1)

$$dS_X = (V_S \cos\theta + V_M)\, dt \quad (3)$$

where $\theta$ is measured in angular measure (radians). Furthermore, if the cutter diameter is $D_W$, then $$V_S = D_W\, \omega/2 \text{ where } \omega = d\theta/dt$$

and $$V_S = D_W d\theta/2dt \quad (4)$$

From this $$dt = D_W d\theta/2V_S$$

If $n_W$ is the speed of rotation of the cutter, $$V_S = D_W\, \pi\, n_W/10$$

Substituting this value of $V_S$ and integrating $$t = 10\,\theta/2\pi n_W \quad (5)$$

Since the initial conditions are $t_o = 0$ and $\theta_o = 0$, the constant of integration is also zero.

If the speed of advance $V_M$ of the mining machine is constant, substitution of Equation (4) in Equation (3) and integration yields $$dS_X = (D_W d\theta/2dt) \cos\theta\, dt + V_M dt$$

$$\int dS_X = D_W/2 \int \cos\theta\, d\theta + V_M \int dt$$

Performing the integration and substituting the value of $t$ from Equation (5) gives $$S_X = D_W/2 \sin\theta + 10\, V_M \theta/2 n_W\, \pi \quad (6)$$

If the cutter drum diameter $D_W$, the speed $V_M$ and the speed of rotation $n_W$ are constant, the position of maximum depth of cut as a function of the angle $\theta$ is given by $$dS_X/d\theta = 0$$

Using the value of $S_X$ from Equation (6)

$$\frac{dS_X}{d\phi} = \frac{D_W}{2} \cos\phi + \frac{10\, V_M}{2\pi\, n_W} = 0 \quad (7)$$

and $$\cos\phi = -\frac{10\, V_M}{n_W D_W\, \pi}$$

If the speed $V_M$ is taken as 15 meters/minute, the cutter drum speed as 44 rev./minute, and the diameter $D_W$ as 1600 millimeters, then from Equation (7) the maximum depth of cut occurs when $\cos\theta = -0.06782$, that is, when the angle $\theta$ is 93.89°.

Figure 4:
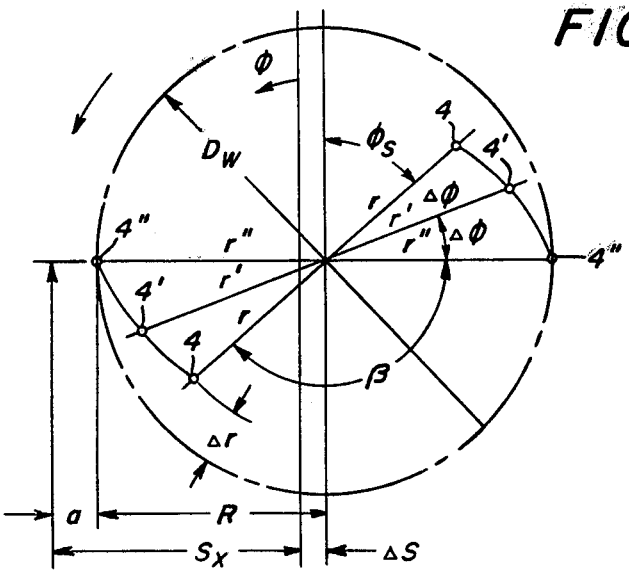
FIG. 4 is a diagram showing the arrangement of sets of cutter picks on the end of a cutter drum.

Referring now to FIG. 4, which shows diagrammatically the positions of two sets of cutter picks 4 on the end of a cutter drum which is moving to the left and rotating as shown by the arrow, and substituting R for $D_W/2$, the depth of cut $a$ is (see also FIG. 2)

$$a = S_X - (R - \Delta S)$$

$$S_X = a + R - \Delta S \quad (8)$$

Converting the angle $\theta$ to degrees, $\theta = \pi\, \theta°/180°$ and from Equation (5)

$$t_S = 10\,\theta_S/n_W \cdot 360°$$

Since $\Delta S = V_M t_S$, $$\Delta S = 10\, V_M \theta_S/n_W \cdot 360° \quad (9)$$

where $\theta_S$ must be expressed in degrees and represents the angular movement of the cutter drum corresponding to the time $t_S$.

From Equations (8) and (9)

$$S_X = a + \frac{D_W}{2} - \frac{10\, V_M \phi_S}{n_W \cdot 360°} \quad (10)$$

If $\theta = 90°$ or $\pi/2$ radians and $\sin\theta = 1$, then from Equation (6) for the radially innermost picks 4 of FIG. 4, $$S_X = r + \frac{10\, V_M\, \pi}{2\pi\, n_W \cdot 2} \quad (11)$$

-continued $$S = r + \frac{10\,V_M}{4n_W}$$

In this equation $r$ is the radius in millimeters to the point of the cutter pick 4 in FIG. 4 and its value can be obtained by equating the right-hand sides of Equations (10) and (11)

$$r + \frac{10\,V_M}{4n_W} = a + \frac{D_W}{2} - \frac{10\,V_M\phi_s}{n_W \cdot 360^\circ} \tag{12}$$

$$r = a + \frac{D_W}{2} - \frac{10\,V_M}{4n_W}\left(\frac{1 + \phi_s}{90^\circ}\right)$$

The angle $\beta$ is the angle between the positions of the last pick of one set of cutter picks and the first pick of the next set, and from FIG. 4 the angle $\theta_S = \beta - 90^\circ$. Substituting in Equation (12)

$$r = a + \frac{D_W}{2} - \frac{10\,V_M}{4n_W}\left(1 + \frac{\beta - 90^\circ}{90^\circ}\right) \tag{13}$$

$$= a + \frac{D_W}{2} - \frac{10\,V_M}{4n_W} \cdot \frac{\beta}{90^\circ}$$

The value of $r$, that is, the radius from the axis to the points of the cutter picks 4, can be determined for given depths of cut $a$ and for known speeds of rotation $n_W$ and speeds of advance $V_M$, the angle $\beta$ being fixed in the design of the cutter drum.

From FIG. 4

$\Delta r = R - r$ Substituting in Equation (13)

$$R - \Delta r = a + \frac{D_W}{2} - \frac{10\,V_M}{4n_W} \cdot \frac{\beta}{90^\circ} \tag{14}$$

and $$\Delta r = \frac{10\,V_M}{4n_W} \cdot \frac{\beta}{90^\circ} - a \tag{15}$$

If $Z$ is the number of cutter picks in each set, the radial difference $\Delta r'$ between adjacent picks 4 and 4', or 4' and 4'', is $$\Delta r'' = \Delta r/Z - 1 \tag{16}$$

or $$\Delta r'(Z-1) = \Delta r$$

That is, as seen in FIG. 4, $$r' = r'' - \Delta r'$$

$$r = r' - \Delta r'$$

From Equation (15), therefore, $$\Delta r'(Z - 1) = \frac{10\,V_M}{4n_W} \cdot \frac{\beta}{90^\circ} - a \tag{17}$$

and

-continued $$\Delta r' = \frac{1}{Z - 1}\left[\frac{10\,V_M}{4n_W} \cdot \frac{\beta}{90^\circ} - a\right]$$

The depth of cut of the individual cutter picks is determined by the dimension $\Delta r'$ and by the speed of advance $V_M$ of the mining machine.

If $\Delta\theta$ in degrees is the angular distance between adjacent picks of each set, then the distance $\Delta S$ is the travel of the mining machine during the time $t_{\Delta\theta}$ required for the picks to move through the angle $\Delta\theta$ and $\Delta_S = V_M t_{\Delta\theta}$. Therefore (see Equation (9))

$$t_{\Delta\theta} = 10\,\Delta\theta/n_W \cdot 360^\circ \tag{18}$$

The depth of cut $a = \Delta S + \Delta r'$
or $$a = V_M t_{\Delta\theta} + \Delta r/Z - 1 \tag{19}$$

Substituting Equations (15) and (18) in Equation (19)

$$a = V_M \frac{10\,\Delta\phi^\circ}{n_W \cdot 360^\circ} + \left(\frac{\frac{10\,V_M}{4n_W} \cdot \frac{\beta}{90^\circ} - a}{Z - 1}\right) \tag{20}$$

$$a \cdot (Z - 1) = \frac{10\,V_M\,\Delta\phi^\circ\,(Z - 1)}{n_W \cdot 360^\circ} + \frac{10\,V_M\,\beta}{360^\circ \cdot n_W} - a$$

$$az - a + a = \frac{10\,V_M}{n_W \cdot 360^\circ}\,[\Delta\phi^\circ \cdot (Z - 1) + \beta]$$

$$az = 2.77 \cdot \frac{V_M}{n_W}\,[\Delta\phi^\circ\,(Z - 1) + \beta]$$

$$a = 2.77\,\frac{V_M}{Zn_W}\,[\Delta\phi^\circ\,(Z - 1) + \beta]$$

From Equation (20), the depth of cut $a$ can be calculated for a given number of cutter picks per set, or for a known depth of cut the number of cutter picks and angle $\Delta\theta$ are determined.

We claim as our invention:

1. A screw-type cutter drum for mining machines having a cylindrical body portion with helical ribs thereon, a plurality of cutter picks carried on said ribs, and a plurality of cutter picks carried on the end of said body portion and positioned in a common plane perpendicular to the axis of the body portion, said last-mentioned cutter picks being disposed in sets corresponding in number and position to said ribs, and the cutter picks in each set being equally spaced angularly from each other and placed at decreasing radial distances from the axis of the body portion, the difference in radius between adjacent picks being constant and given by $$\Delta r' = \frac{1}{z - 1}\left[\frac{10\,V_M}{4n_W} \cdot \frac{\beta}{90^\circ} - a\right]$$

where:

$Z$ = the number of cutter picks per set;
$V_M$ = the transverse speed of advance of the drum;
$n_W$ = the rotational speed of the drum;
$\beta$ = the angle between adjacent cutter picks of different sets; and
$a$ = the depth of cut of each cutter pick.

2. A cutter drum as defined in claim 1 in which said sets of cutter picks are mounted directly on the end of said body portion.

3. A cutter drum as defined in claim 1 in which said sets of cutter picks are mounted on an end plate attached to the end of said body portion.

* * * * *